United States Patent [19]

Pienta

[11] Patent Number: 4,720,231

[45] Date of Patent: Jan. 19, 1988

[54] TRANSFER DEVICE

[75] Inventor: David J. Pienta, Temperance, Mich.

[73] Assignee: Automatic Handling, Inc., Erie, Mich.

[21] Appl. No.: 792,019

[22] Filed: Oct. 28, 1985

[51] Int. Cl.[4] ..... B65H 19/30

[52] U.S. Cl. ..... 414/560; 414/749; 414/911; 29/791; 29/824; 242/58.6

[58] Field of Search ..... 414/749, 911, 751, 753, 414/560, 745; 29/791, 793, 794, 822, 823, 824; 242/58.6, 79; 198/468.6

[56] References Cited

U.S. PATENT DOCUMENTS

| | | | |
|---|---|---|---|
| 1,669,837 | 5/1928 | Pancoast | 242/58.6 |
| 1,736,016 | 11/1929 | Rosener | 414/911 X |
| 3,239,076 | 3/1966 | Huff et al. | 29/822 X |
| 3,348,785 | 10/1967 | Locker III | 242/79 X |
| 3,995,747 | 12/1976 | Lewey et al. | 242/79 X |
| 4,431,142 | 2/1984 | Kataoka | 242/58.6 X |
| 4,595,328 | 6/1986 | Seitz et al. | 242/58.6 X |

FOREIGN PATENT DOCUMENTS

| | | | |
|---|---|---|---|
| 70251 | 6/1981 | Japan | 242/58.6 |

*Primary Examiner*—F. J. Bartuska
*Assistant Examiner*—Nils E. Pedersen
*Attorney, Agent, or Firm*—Emch, Schaffer, Schaub & Porcello

[57] ABSTRACT

A transfer device is disclosed for moving objects that are supported on a shaft from a receiving station to a transfer station. The shafts are disposed in adjacent substantially parallel relationship. A track extends from the receiving station to the transfer station. Moveable lifting hooks are positioned on the track. The lifting means is disposed for engaging the shafts so that the shafts and the objects supported thereon can be transferred from the receiving station to the transfer station. Each lifting hook is independently moveable to engage the shafts and the lifting hooks are moveable along the track so that the shafts and the objects supported thereon can be lifted and transported from the receiving station to the transfer station.

24 Claims, 15 Drawing Figures

TRANSFER DEVICE

BACKGROUND OF THE INVENTION

This invention relates to a transfer device that can be used to transport material that is supported on a shaft. More particularly, the invention relates to a transfer deivce that can be used to transport rolls of cut paper that are rotatably positioned on support shafts.

In the paper industry it has been common to have a large roll of paper that is cut into smaller widths as these smaller widths are more useful for later applications. The paper is slit as it is unrolled from the large roll and then the paper is rewound on separate shafts that are spaced apart from the large roll. The paper is normally collected on the support shafts in a staggered fashion so that adjacent sections of cut paper are positioned on different support shafts. The staggered positioning of the cut paper is necessary to ensure that the cut sections of paper are fully separated and to prevent any interaction or birdnesting between adjacent sections of the cut paper as they are rewound on the support shafts. Once the cut paper has been rewound on the support shafts, the rewound cut paper must be moved so that it can be further processed into the desired end use form. Normally a crane is used where workers position the lifting means on the crane to engage and lift the support shafts and then the support shafts are moved by the crane to the next step in the processing operation. At this next station the workers must remove the lifting means on the crane and also usually remove the support shafts from the rolls of cut paper supported thereon. When the shafts have been removed the paper is now ready to be processed in the next station. The workers must then return the support shafts to the original winding station and also return the crane to the initial winding station so that it can be reused to transport the rolls of cut paper. Obviously, there is a great deal of hand labor in this operation and several men can be tied up in this operation. However, when the paper is being wound onto the support shafts there is very little for these men to do during this phase of the operation. Accordingly, there is a great deal of unproductive time for the workers. The present invention is designed to greatly reduce the amount of manual labor that is required in transferring the rolls of cut paper.

It is an object of the present invention to provide an improved transfer device for transferring rolls of cut paper that are supported on a support shaft.

It is a further object of the invention to greatly reduce the amount of manual labor required to transfer rolls of cut paper in a processing operation.

Other objects and advantages of the invention will become apparent from reading the following description in connection with the attached drawings.

SUMMARY OF THE INVENTION

A transfer device is disclosed for moving objects that are supported on a shaft from a receiving station to a transfer station. The shafts are disposed in adjacent substantially parallel relationship. A track means extends from the receiving station to the transfer station. A moveable lifting engagement means is positioned on the track means. The lifting means is disposed for engaging the shafts so that the shafts and the objects supported thereon can be transferred from the receiving station to the transfer station. Each lifting means is independently moveable to engage the shafts and the lifting means are moveable along the track means so that the shafts and the objects supported thereon can be lifted and transported from the receiving station to the transfer station.

DESCRIPTION OF THE PREFERRED EMBODIMENTS

Figure 1:
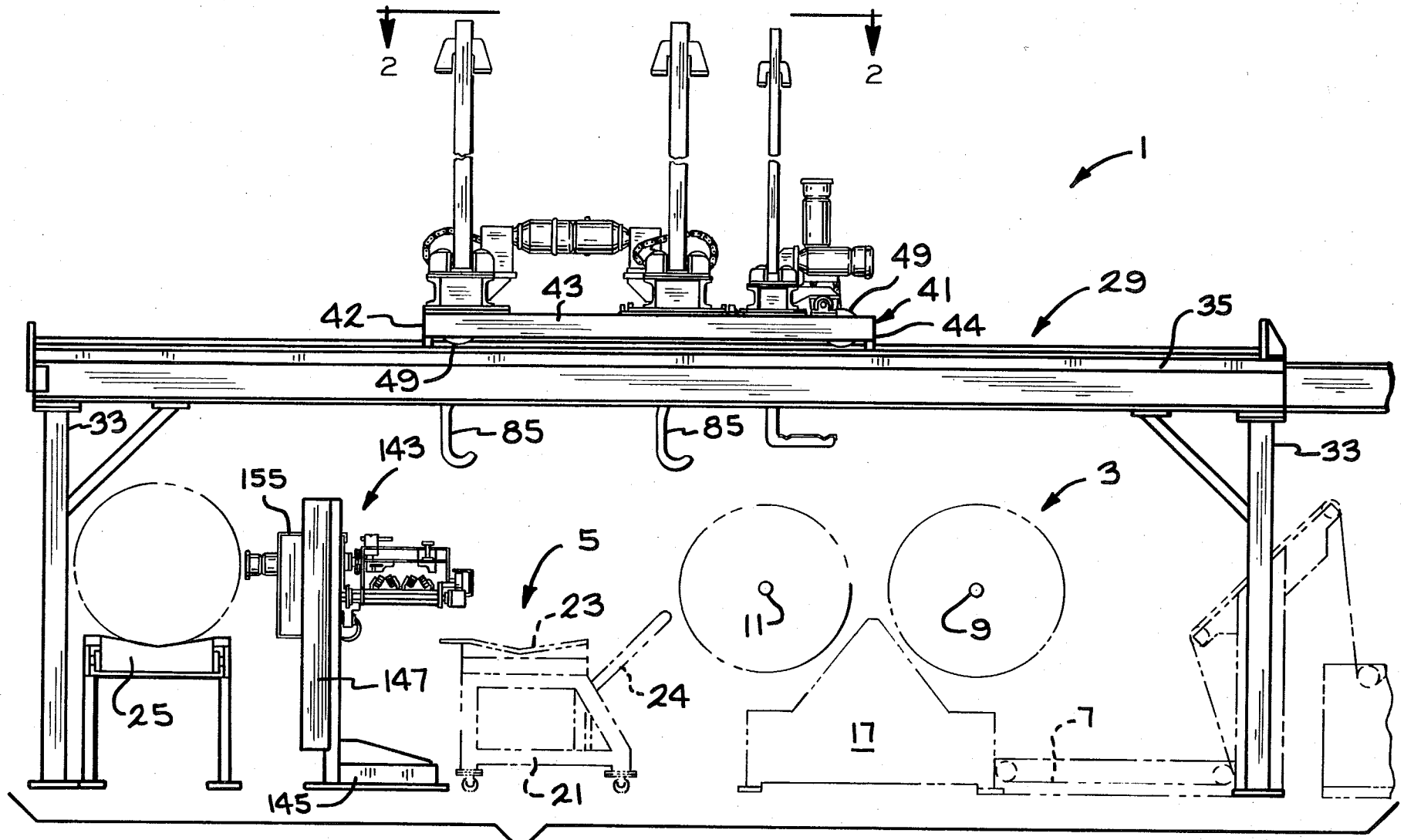
FIG. 1 is a side elevation view of the transfer device of the present invention.
Figure 2:
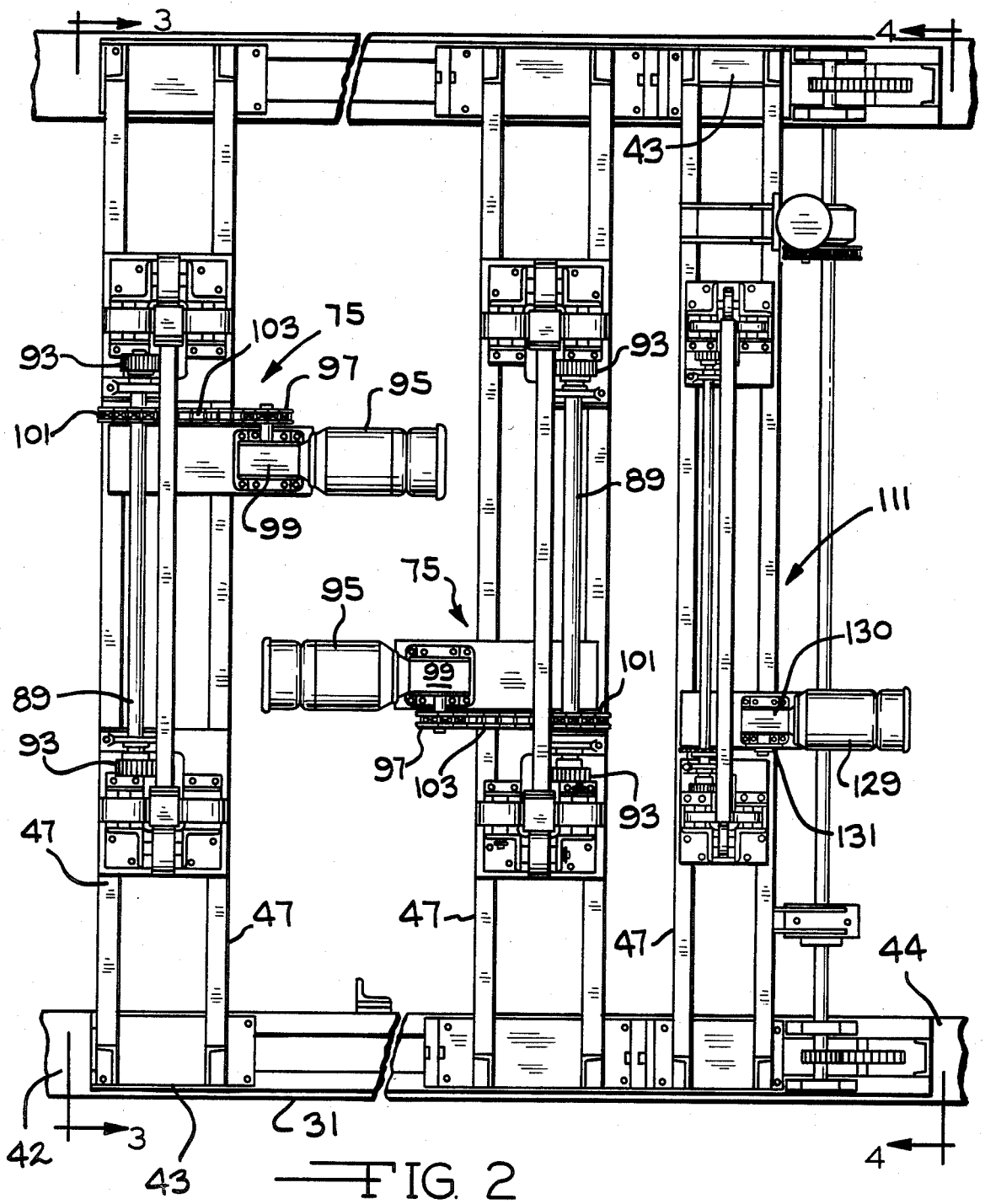
FIG. 2 is a plan view of a portion of the transfer device shown in FIG. 1.
Figure 3:
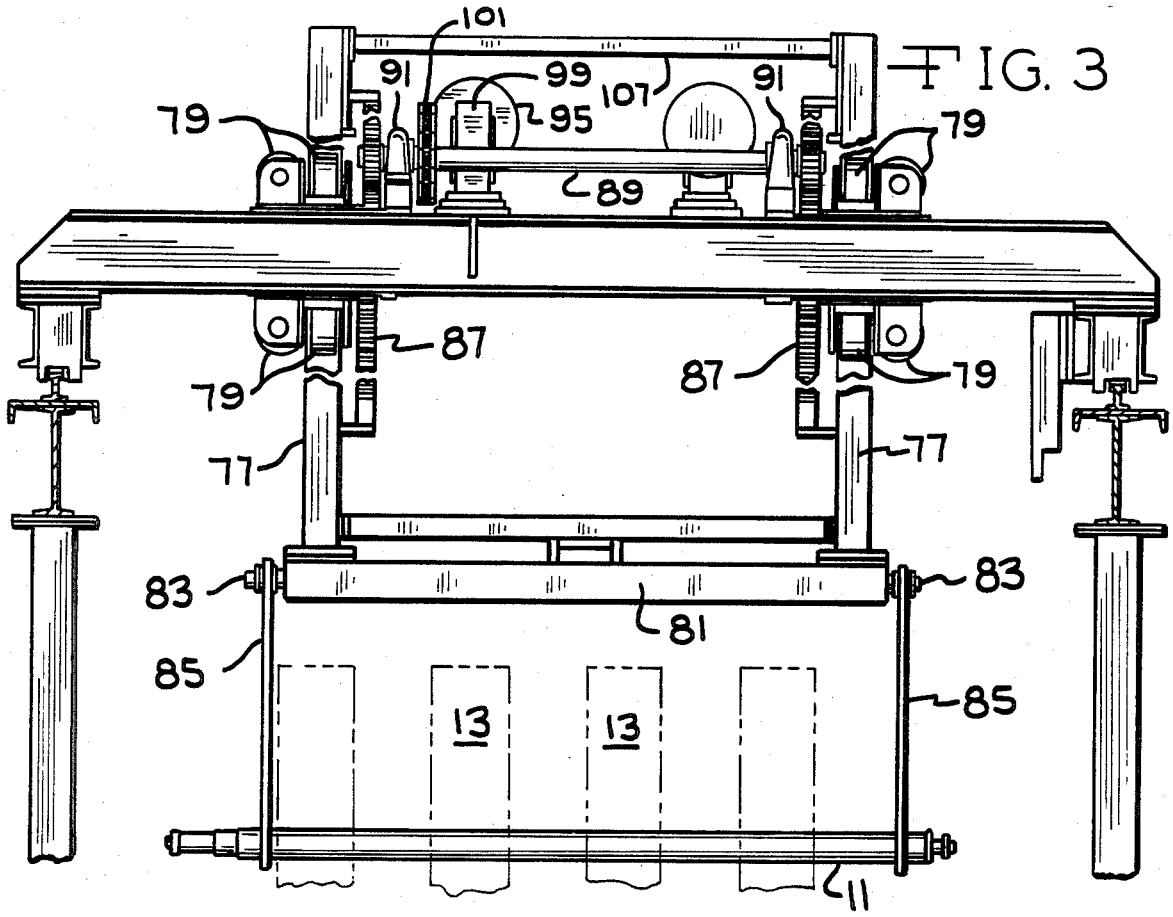
FIG. 3 is a cross-sectional view taken along line 3—3 shown in FIG. 2.
Figure 4:
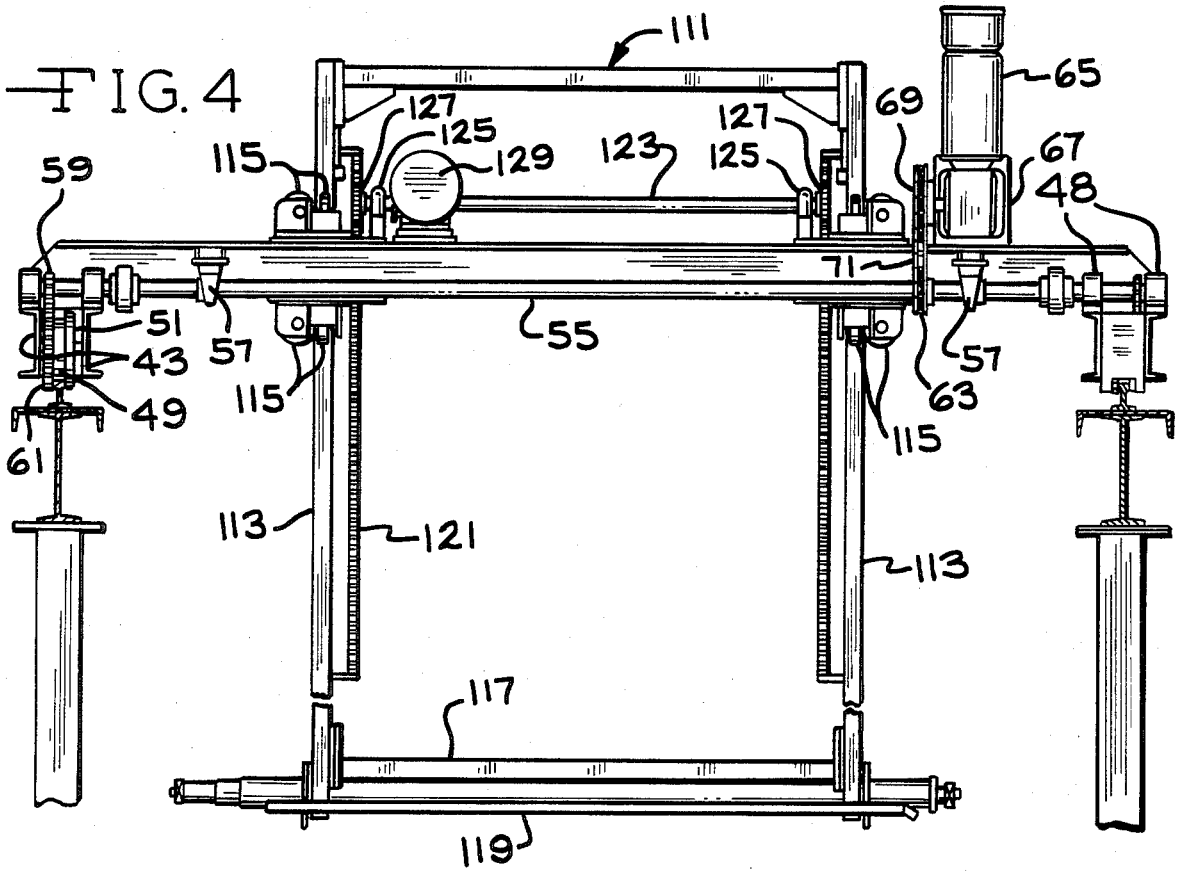
FIG. 4 is a cross-sectional view taken along line 4—4 shown in FIG. 2.
Figure 5:
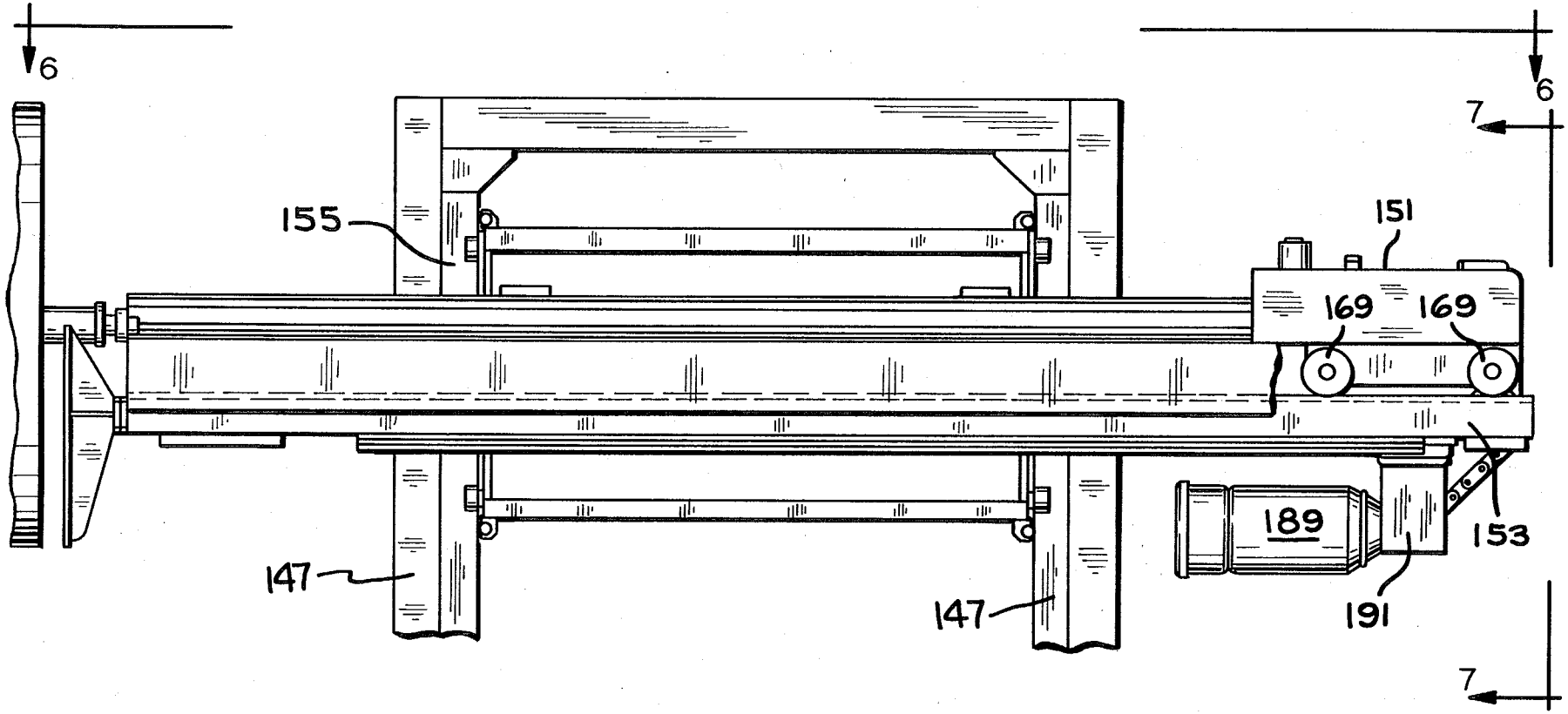
FIG. 5 is a side elevational view of a portion of the transfer device.
Figure 6:
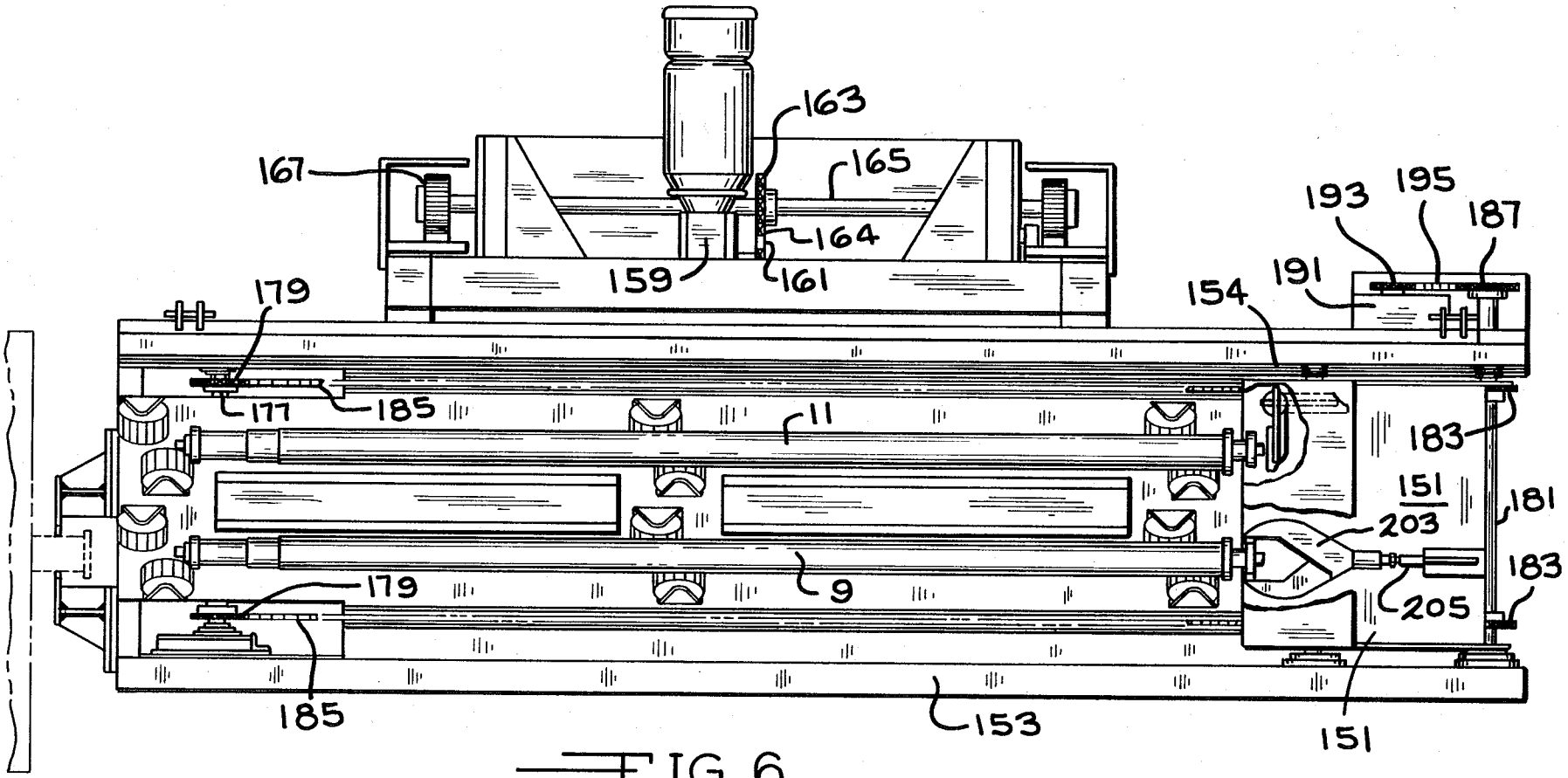
FIG. 6 is a cross-sectional view taken along line 6—6 shown in FIG. 5.
Figure 7:
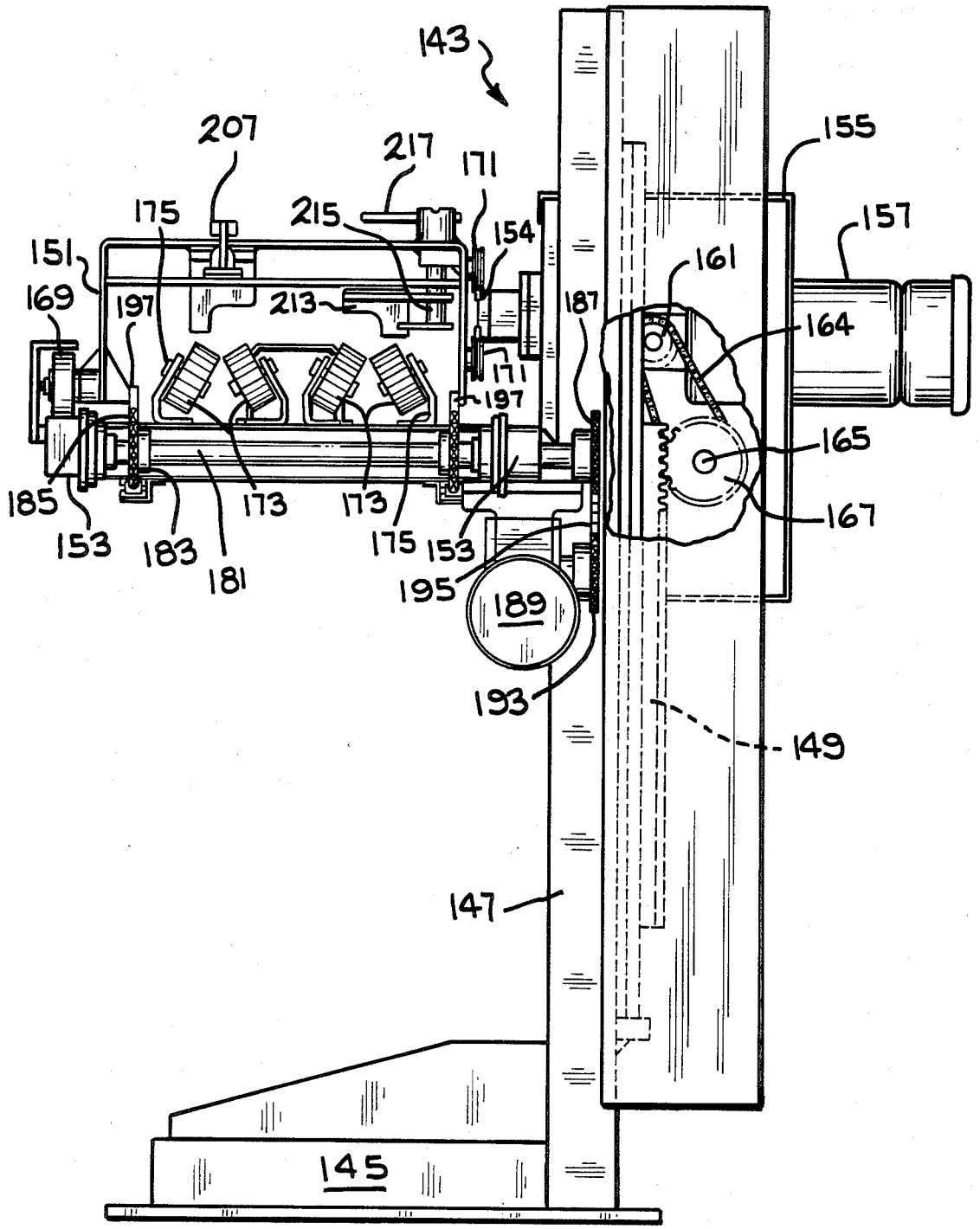
FIG. 7 is a cross-sectional view taken along line 7—7 shown in FIG. 5.

This invention is a transfer device for moving objects that are supported on shafts from a receiving station to a transfer station. More particularly, the invention is used to transfer rolls of slit paper from a receiving or winding station to a transfer station where the slit paper can be further processed. Features of the invention will be more fully understood by referrring to the attached drawings in connection with the following description.

The transfer device 1 has a receiving station 3 and a transfer station 5. In the receiving station 3 paper 7 that has been slit is fed from a large roll (not shown) onto a first shaft 9 and a second shaft 11. The first and second shafts are rotatably mounted in spaced apart substantially parallel relationship. The slit paper 7 is fed onto the first and second shafts in an alternating fashion so that a plurality of rolls of paper 13 are positioned on each shaft. The rolls of paper 13 are in spaced apart relationship on each shaft and the rolls of paper on first shaft 9 are in staggered relationships to the rolls of paper on second shaft 11. The first shaft 9 and second shaft 11 are mounted above a support block 17 that provides spacing between the rolls of paper on the first and second shafts. The first and second shafts are also rotatably and releasably secured to the end walls (not shown) of the support block 17.

Positioned in spaced apart relationship with the receiving station 3 is the transfer station 5. The transfer station 5 has a moveable cart 21 that is disposed for receiving the rolls of paper 13 that are positioned on either the first or second shaft. The moveable cart 21 has a receiving surface 23 for supporting the rolls of paper 13. The moveable cart 21 is positioned adjacent a conveyor 25. The conveyor 25 extends from the transfer device 1 and is used to move the rolls of paper 13 to different locations for further processing. The receiving surface 23 of the moveable cart 21 is positioned at substantially the same height as the conveyor 25. Further, the receiving surface 23 is tipable by using handle 24 so that the rolls of paper 13 can be rolled from the receiving surface 23 onto the surface of the conveyor 25.

Positioned above the receiving station 3 and transfer station 5 is track means 29. The track means 29 has opposed support beams 31 that extend from the receiving station 3 to the transfer station 5 and the support beams 31 also extend over the conveyor 25. The support beams 31 are disposed substantially perpendicular to the first and second shafts and the support beams 31 are spaced so that the first and second shafts can be positioned between the opposed support beams. The support beams 31 are held in place over the receiving station 3 and transfer station 5 by vertical support columns 33. Positioned on the support beams 31 are guide beams 35. The guide beams 35 are also positioned in opposed spaced apart relationship and the guide beams 35 and support beams 31 are positioned at substantially the same height above the receiving station 3 and transfer station 5.

A moveable carriage 41 is positioned on the track means 29. The moveable carriage 41 has opposed side rails 43 that are disposed in substantial alignment with the support beams 31 of the track means 29. A plurality of transverse rails 47 extend between the side rails 43 to form the moveable carriage 41. The transverse rails 47 are disposed substantially perpendicular to the side rails 43. The transverse rails 47 are disposed with two transverse rails in close spaced apart relationship adjacent the first end 42 of the moveable carriage 41, with two transverse rails positioned in close spaced apart relationship in substantially the center of the moveable carriage 41 and two transverse rails located in close spaced apart relationship near the second end 44 of the carriage 41. Positioned on the first end 42 of the moveable carriage 41 are a pair of rotatable wheels 49 that are mounted in opposed relationship on the side rails 43. The wheels 49 are disposed to engage the guide beams 35 of the track means 29 for moveably supporting the carriage 41 on the track means. At the second end 44 of the moveable carriage 41 there is another pair of wheels 49 that are mounted on the side rails 43 of the moveable carriage 41. Positioned adjacent each wheel 49 on the inside of the carriage 41 is a spacer 51 that is attached to the wheel 49. The spacer has a slightly larger diameter than the diameter of the wheel 49 so that the spacer extends below the top of the guide beam 35. The spacers 51 rotatably engage the side of the guide beams 35 and act to maintain the wheels 49 in position on top of the guide beams 35.

At the second end 44 of the carriage 41 a rotatable shaft 55 extends transversely across the moveable carriage 41 and extends above the wheels 49 located on this end of the carrage. The rotatable shaft 55 is supported in bearings 57 that are connected to the transverse rails 47 and bearings 58 that are connected to the side rails 43. A gear 59 is positioned on each end of the rotatable shaft 55. The gear 59 is disposed to engage a gear 61 that is connected to each of the wheels 49 on the second end of the moveable carriage 41. A drive sprocket 63 is positioned on the rotatable shaft 55. Positioned on the transverse rails 47 above the rotatable shaft 55 is a motor 65. The motor 65 is operatively connected to a gear reducer 67 and sprocket 69 is mounted on the output shaft of the gear reducer 67. The sprocket 69 is disposed to be alignment with the drive sprocket 63 on the rotatable shaft 55. A suitable chain 71 is used to operatively connect the drive sprocket 63 to the sprocket 69. Thus, the motor 65 can be used to rotate the shaft 55 and the wheels 49 to cause the carriage 41 to advance along the guide beams 35 of the track means 29. In this manner, the carriage 41 can be moved from the receiving station 3 to the transfer station 5.

Positioned adjacent the first end 42 of the moveable carrage 41 are a pair of transverse rails 47 that are positioned in adjacent spaced apart relationship. In substantially the center of the moveable carriage 41 there is an additional pair of transverse rails 47 that are located in adjacent spaced apart relationship. A lifting means 75 is positioned on each of the pair of transverse rails 47. The lifting means has a pair of opposed vertical rails 77 that are positioned in substantially parallel relationship. The vertical rails are moveably mounted to the transverse rail 47. The vertical rails are maintained in the proper orientation by a plurality of rotatable wheels 79 that are positioned on the upper and lower surface of the transverse rails 47 and engage three sides of the vertical rails 77. The rotatable wheels 79 therefore provide support and location for the vertical rails 77 while leaving the vertical rails 77 free to move in a vertical direction. A portion of the vertical rails 77 extends from the moveable carriage 41 in a direction towards the rolls of paper 3 and a cross-member 81 is connected to this end of the vertical rail 77. Extending from each end of the cross-member 81 are pins 83 and pivotly connected to the pins 83 are hooks 85. The hooks 85 are disposed for engaging the first or second shafts that support the rolls of paper 13. Securely fastened to each of the vertical rails 77 is a gear rack 87. A transfer shaft 89 is rotatably supported on the moveable carriage 41 in bearings 91. On each end of the transfer shaft 89 there is positioned a gear 93 that is disposed for engaging the gear racks 87 that connected to each vertical rail 77. A motor 95 is positioned on the moveable carriage 41 and the motor drives sprocket 97 through a gear reducer 99. The sprocket 97 is operatively connected to drive sprocket 101 on the transfer shaft 89 by means of a chain 103. Positioned on the end of the vertical rails 77 that is opposite from the rolls of paper 13 is a brace 107 that extends between the vertical rail 77. The brace 107 limits the travel of the vertical rails 77 in a direction towards the rolls of paper 13.

Positioned on the pair of transverse rails 47 that are located adjacent the second end 44 of the moveable carriage 41 is the shaft transfer means 111. The shaft transfer means 111 has a pair of vertical rails 113 that are positioned in opposed and substantially parallel relationship. The vertical rails 113 are moveably supported on the transverse rails 47 by a plurality of rotatable wheels 115 that are rotatably mounted on the upper and lower surface of the transverse rails 47. The rotatable wheels 115 engage three sides of the vertical rails 113 and moveably support and align the vertical rails 113. On the end of the vertical rails 113 that extends from the moveable carriage 41 in a direction towards the rolls of paper 13 there is a cross-member 117 that extends between the ends of the vertical rail 113. Secured to the end of the vertical rails 113 and the cross-member 117 is a tray 119 that is disposed for supporting either the first or second shafts upon which the rolls of paper 13 are positioned. The tray 119 has a pair of grooves 120 for receiving the first and second shafts. Secured to each of the vertical rails 113 is a gear rack 121. Positioned on the moveable carriage 41 is a transverse shaft 123 that is rotatably positioned in bearings 125. One each end of the transverse shaft 123 is a gear 127 that is disposed for engaging the gear rack 121 that is connected to the vertical rails 113. A drive motor 129 is operatively connected to a gear reducer 130 and drives a sprocket 131 which is connected to the output shaft of the gear reducer 130. The sprocket 131 is operatively connected to a drive sprocket 133 located on the transverse shaft 123 by means of a chain 135.

Positioned adjacent the transfer station 5 is gripper means 143. The gripper means has a base 145 and a vertical support column 147 that is secured to the base 145. A moveable carriage 151 is positioned on guide rails 153. The guide rails 153 are positioned substantially parallel to the first and second shafts that support the rolls of paper 13. The guide rails 153 extend in a direction away from the transfer station 5. The guide rails 153 are connected to support frame 155 and the support frame is moveably positioned on the support columns 147. A guide bar is positioned in parallel spaced apart relationship to the guide rail that is positioned adjacent the support frame 155. A grear rack 149 is connected to the support columns 147. The support frame 155 has a motor 157 mounted thereon and the motor is connected to gear reducer 159 and through the gear reducer to sprocket 161. The sprocket 161 is connected to drive sprocket 163 that is mounted on rotatable shaft 165. The shaft 165 is rotatably supported in the support frame 155. A chain 164 operatively connects the sprocket 161 to the drive sprocket 163. A gear 167 is positioned on each end of the shaft 165. The gears 167 are disposed for engaging the gear rack 149. Thus, rotation of the motor 157 causes the shaft 165 to rotate which in turn causes the gear 167 to advance along the gear rack 149 connected to the support columns 147 of the gripper means 143. The movement of the gear 167 along the gear rack 149 varies the height of the support frame 155, the guide rails 153 and the moveable carriage 151.

The moveable carriage 151 is supported on the side that is spaced apart from the support frame 155 by rotatable wheels 169 that rotatably engage guide rail 153. On the other side of the moveable carriage 151 are rotatable wheels 171 that are disposed to rotatably engage each side of guide bar 154. The wheels 169 and wheels 171 moveably support the carriage 151 on the guide rail 153 and the guide bar 154. Positioned between the guide rail 153 and the guide bar 154 are two rows of rollers 173. The rollers are supported on brackets 175 into opposed substantially parallel rows. The rollers are also disposed in rows that are substantially parallel to the guide rails 153. The rollers are positioned in their respective rows in a converging relationship so that the upper surface of each adjacent pair of rollers forms a V-shape guide surface. The rollers 173 are disposed so that the moveable carriage 151 can pass over the rollers as the moveable carraige advances along the guide rail 153 and guide bar 154. The rollers 173 are disposed for receiving either the first or second shaft upon which the rolls of paper 13 can be positioned.

On the end of the guide rails 153 that are adjacent the transfer station 5 there is rotatable shaft 177 that is rotatably connected to the guide rails 153. A sprocket 179 is positioned on each end of the shaft 177 adjacent to the guide rails 153. On the opposite end of the guie rails 153 there is a second rotatable shaft 181 that is rotatably secured to the guide rails 153. A second sprocket 183 is positioned on each end of the second shaft 181 adjacent to the guide rails 153. A chain 185 passes around the sprockets 179 and second sprocket 183 adjacent to each guide rail 153. One end of the second shaft 181 extends beyond guide rail 153 in a direction towards the support frame 155. A sprocket 187 is secured to this end of the second shaft 181. A motor 189 is positioned beneath the second shaft 181 adjacent to the support column 147 for the gripper means 143. The motor is connected to a gear reducer 191 and the motor drives sprocket 193 through the gear reducer. A chain 195 operatively connects the motor driven sprocket 173 to the sprocket 187 that is positioned on the second rotatable shaft 181. The moveable carriage 151 is connected to the chain 185 by means of links 197. The links 197 secure the moveable carriage 151 to the chain 185 so that the motor 189 through the connection between the sprocket 193 and the sprocket 187 can cause second rotatable shaft 181 to rotate to advance the chain 185 thereby advancing the moveable carraige 151.

Positioned in the moveable carriage 151 is a gripper jaw 203. A control bar 205 extends from the gripper jaw 203 and the control bar is connected to handle means 207. The handle means is positioned to allow a manual opening and closing of the gripper jaws by movement of the handle means. The gripper jaws 203 is disposed so that openable end of the gripper jaw faces the first or second shaft upon which the rolls of paper 13 are mounted. Further, the gripper jaw is constructed so that the jaw is suitable for engaging one end of the first or second shafts and for securely gripping the shaft after the shaft has been positioned in the gripper jaw. Since the gripper jaw 203 is positioned on the moveable carriage 151, the gripper jaw will move with the carriage along the guide rail 153 and the guide bar 154.

Positioned adjacent the gripper jaw 203 on the moveable carriage 151 is a flap 213. The flap 213 is pivotally mounted on rod 215 that is pivotally supported on the housing for the moveable carriage 151. A handle 217 is connected to the rod 215 for pivoting the flap 213. The flap 213 is disposed on the moveable carriage 151 so that the flap is in substantial alignment with the row of rollers 117 that are positioned adjacent the support frame 155. The flap 213 can be positioned by the handle 217 so that the flap is substantially perpendicular to the row of rollers 117 or the flap can be pivoted so that it is substantially parallel to the longitudinal axis of the row of rollers 173.

The operation of the transfer device 1 will be more readily understood by referring to the attached drawings in connection with the following description. The paper 7 is cut into narrower widths and advanced from the cutting station (not shown) to the receiving station 3. In the receiving station the paper 7 is wound onto the first shaft 9 and the second shaft 11 to rewind the paper 7 into cylindrical rolls. Adjacent sections of the cut paper 7 are positioned on alternating shafts in the receiving station 3. This results in the cut paper 7 being wound into rolls 13 on the first shaft 9 and the second shaft 11 where there is a space between each of the rolls 13 of the paper. The space between the paper is essentially the same as the width of the cut sections of paper 7. The rolls 13 on the first shaft 9 are in staggered relationship to the rolls 13 that are positioned on the second shaft 11. The cut paper 7 is collected on the first and second shaft in this manner to make sure that the paper is wound into separate rolls 13. If the cut paper is wound onto one shaft it has been found that there is overlap between the sections of paper and it is very difficult to remove or unwind an individual roll of the cut paper for further use. The first and second shafts are disposed so that they can be rotated to collect the paper 7 into the rolls 13. The mechanism for rotating the shafts is well-known and is not shown.

The support block 17 is used to separate the cut paper 7 that is to be positioned on the first shaft 9 and the second shaft 11. The support block 17 also provides the desired spacing between the first and second shafts during the collection of the cut paper 7 and the rolls of paper 13. Once the paper 7 has been collected into the rolls 13, it is ready for further processing. Accordingly, it is necessary to transfer the rolls of paper from the receiving station 3 to the transfer station 5. The track means 29 is positioned above the rolls of paper and extends from the receiving station 3 to the transfer station 5. A moveable carriage 41 is positioned on the guide beams 35 of the track means 29. The moveable carriage 41 is disposed for moving between the receiving station 3 and the transfer station 5 on the track means 29. A motor 65 is positioned on the moveable carriage 41 and is operatively connected to rotatable shaft 55 through a pair of sprockets and a connecting chain 71 so that the motor 65 can cause the rotatable shaft 55 to rotate. The rotatable shaft 55 has a gear 59 positioned at each end and the gear 59 is disposed to engage gear 61 that is connected to each of the wheels 49 that are located adjacent the second end 44 of the carriage 41. Thus, rotation of the shaft 55 causes the gear 59 to rotate which in turn causes the gear 61 and the wheel 49 to rotate resulting in the moveable carriage 41 being moved along the guide beams 35 of the track means 29. Thus, by operation of the motor 65, the moveable carriage can be caused to move between the receiving station 3 and the transfer station 5. The track means 29 and moveable carriage 41 are positioned above the receiving station 3 and transfer station 5 a sufficient distance so that there is no obstruction of the movement of the moeable carriage 41.

Figure 8:
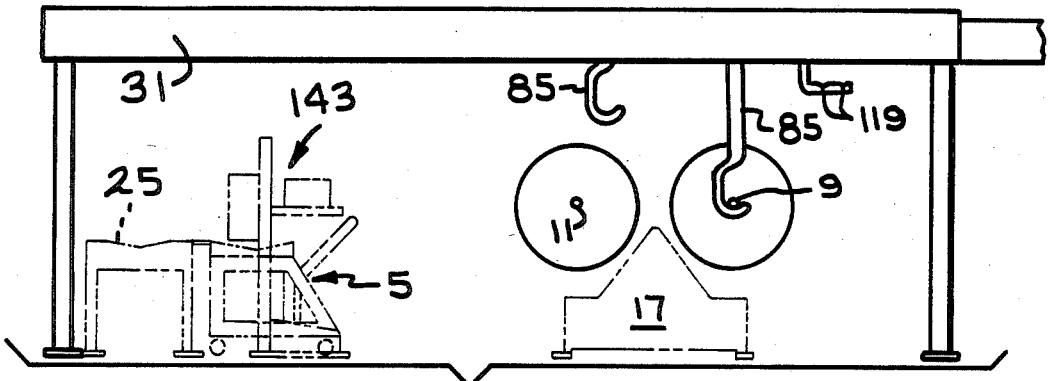
FIG. 8 is a partial side elevation view of the transfer device in operation.
Figure 9:
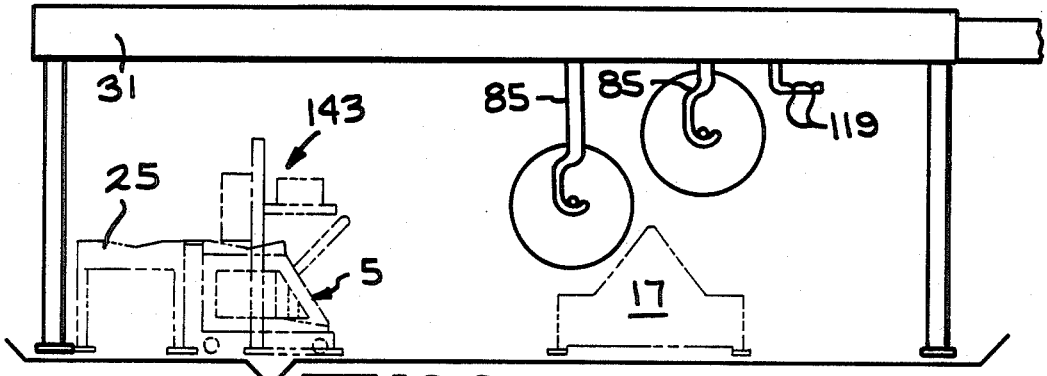
FIG. 9 is a side elevation view of the transfer device in operation.
Figure 10:
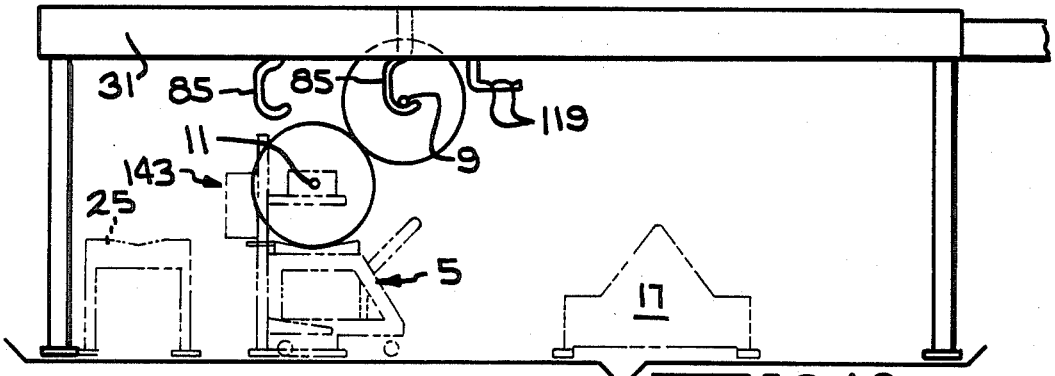
FIG. 10 is a side elevation view of the transfer device in operation.
Figure 11:
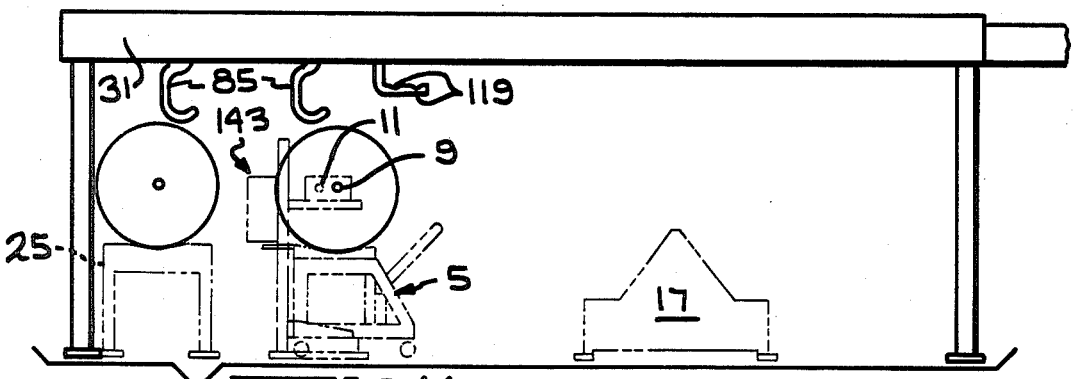
FIG. 11 is a side elevation view of the transfer device in operation.
Figure 12:
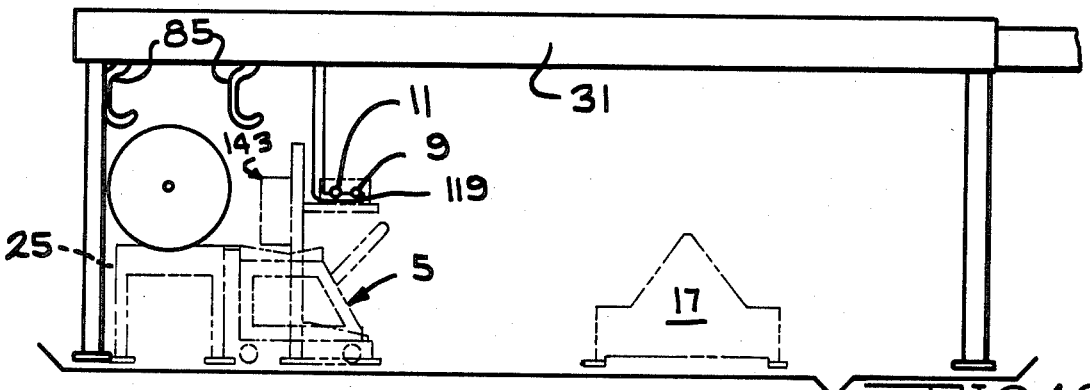
FIG. 12 is a side elevation view of the transfer device in operation.
Figure 13:
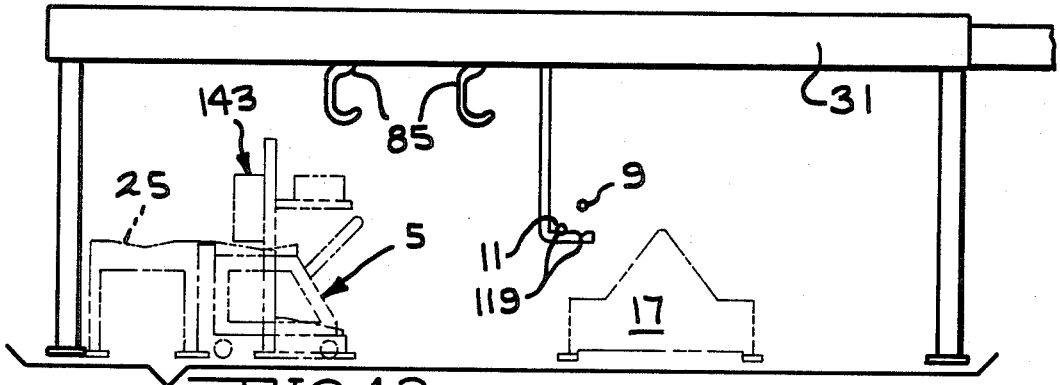
FIG. 13 is a side elevation view of the transfer device in operation.
Figure 14:
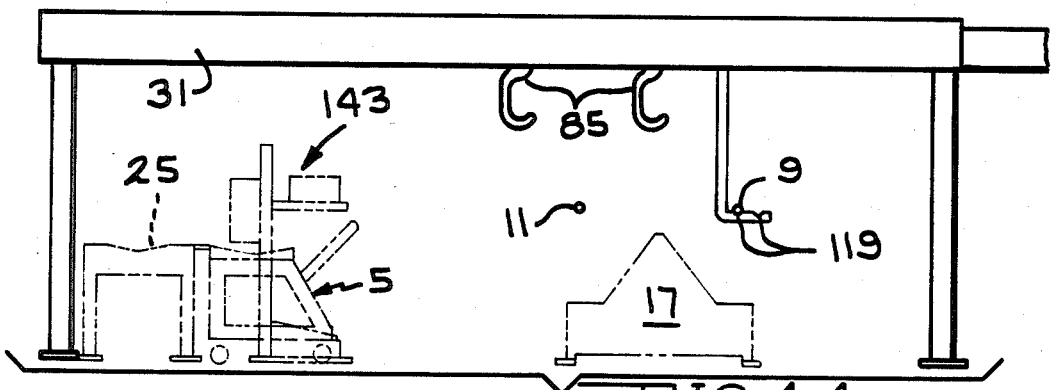
FIG. 14 is a side elevation view of the transfer device in operation.
Figure 15:
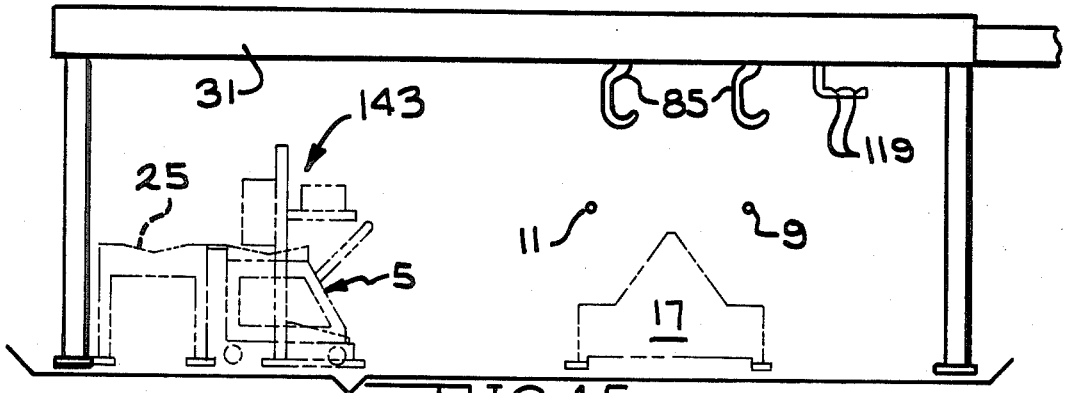
FIG. 15 is a side elevation view of the transfer device in operation.

Extending from the moveable carriage 41 are a pair of hooks 85 that are positioned in substantially the center of the moveable carriage and a pair of hooks 85 that are positioned adjacent the first end 42 of the moveable carriage. The hooks 85 are disposed for engaging the ends of the first and second rotatable shafts. The hooks are disposed so that they engage in the first and second shafts so that the rolls of paper 13 are positioned between the hooks 85. The hooks 85 that extend from substantially the center of the moveable carriage 41 are disposed for engaging the first rotatable shaft 9 and the hooks 85 that extend from substantially the first end 42 of the moveable carriage 41 are disposed for engaging the second rotatable shaft 11. When the paper 7 has been completely wound onto the first and second rotatable shafts to form rolls 13, the moveable carriage is advanced along the guide beam 35 of the track means 29 so that the hooks 85 are in position for engaging the first shaft 9 and the second shaft 11. The operation of the transfer device to transfer the rolls of paper 13 will best be understood by also referring to FIGS. 8–15 that show the various steps of this operation. When the moveable carriage 41 is positioned over the receiving station 3, the motor 95 is activated to rotate the transfer shaft 89 to cause the gears 93 located at the end of the transfer shaft to rotate. As the gears 93 engage the gear racks 87 that are connected to the vertical rail 77, this causes the hooks 85 that are connected to the vertical rails 77 to advance towards the first and second shafts in the receiving station. Normally the hooks 85 that are positioned in substantially the center of the moveable carriage 41 are advanced first and caused to engage the first shaft 9. This is accomplished by advancing the hooks below the level of the first shaft 9 and then advancing the carriage 41 so that they hooks 85 are positioned around the first shaft 9. Then the hooks 85 are caused to advance towards the carriage 41 by the motor 95 so that the hooks firmly engage the first shaft 9. When the hooks have properly engaged the first shaft 9, the motor 95 is caused to continue to rotate so that the gear 93 will advance the gear racks 87 that are connected to the vertical rail 77 to lift the first shaft 9 and the rolls of paper 13 supported thereof in a direction towards the track means 29. The first shaft is advanced towards the track means 29 until the rolls of paper 13 on the shaft are positioned above the support block 17 and adjacent the track means 29. Once the first shaft 9 has been engaged and lifted by the hooks 85 that are located in substantially the center of the carriage 41, the carriage is moved so that the hooks 85 located adjacent to the first end 42 of the moveable carriage 41 are in alignment with the second shaft 11. The hooks 85 are then positioned to engage the second shaft 11 as previously described and the second shaft 11 and the rolls of paper 13 supported on the second shaft are lifted from the receiving station 3 in a direction towards the moveable carriage 41 is previously described.

Once the first shaft 9 and the second shaft 11 and the rolls of paper 13 supported thereon have been lifted by the hooks 85 the motor 65 connected to the carriage 41 is activated to rotate shaft 55. The rotation of shaft 55 causes the gears 59 located on the end of the shaft 55 to rotate. The gears 59 engage gear 61 that are attached to the wheels 49 that are positioned adjacent the second end 44 of the carriage 41. This rotation of the wheels 49 causes the carriage 41 to advance along the guide beams 35 of the track means 29. The motor 65 is caused to rotate so that the carriage 41 and the first shaft 9 and second shaft 11 suspended on the hooks 85 are moved from the receiving station 3 to the transfer station 5. Once the first shaft 9 and second shaft 11 are suspended on the hooks 85 adjacent to the transfer station 5, the motor 65 is deactivated so that the carriage remains stationary on the track means 29. The motor 95 for the hooks 85 that are positioned adjacent the first end 42 of the carriage 41 is then activated to advance the second shaft 11 and the rolls of paper 13 supported thereon towards the moveable cart 21. When the rolls of paper 13 engage the moveable cart 21, the hooks 85 will be advanced below the second shaft 11 and the moveable carriage 41 will be caused to advance by the motor 65 in a direction away from the receiving station 3 so that the hooks 85 no longer are in position to engage the second shaft 11. The hooks 85 that are positioned adjacent the first end 42 of the moveable carriage 41 are then caused to advance in a direction towards the carriage 41 by activating the motor 95 as previously described. The hooks 85 are advanced towards the carriage 41 so that they are located completely above the rolls of paper 13 that are supported on the moveable cart 21.

The moveable cart 21 is positioned to be adjacent the gripper means 143. The motor 157 connected to the support frame 155 of the gripper means is activated to rotate sprocket 161 which is operatively connected to the sprocket 163 on shaft 165 by chain 164. The rotation of the drive sprocket 163 causes gears 167 located on the ends of shaft 165 to rotate. The gears 167 are disposed to engage gear rack 149 that is connected to the support column 147 for the gripper means 143. Movement of the gears 167 will cause the support frame 155, guide rails 153 and moveable carriage 151 to move in a vertical direction. The motor 157 is rotated until the gripper jaw 203 located in the moveable carriage 151 is in substantial alignment with the second shaft 11. Motor 189 located on the moveable carriage 151 is then activated to rotate sprocket 193 which is operatively connected to sprocket 187 on second rotatable shaft 181 by means of a chain 195. Rotation of the second rotatable shaft 181 will cause second sprockets 183 on the end of the second shaft 181 to rotate. The second sprockets 183 engage chain 185 that extends around sprockets 179 located on shaft 177 on the end of guide rails 153 that is are located adjacent to the transfer station 5. The chain 185 makes a continuous loop around the sprockets 179 and second sprockets 183. The moveable carriage 151 is connected to the chain 185 by links 197. Accordingly, advancement of the chain 185 will cause the moveable carriage 151 to advance along the guide rails 153. The moveable carriage 151 is advance until the gripper jaw 203 is in position to engage the end of second shaft 11. Handle means 207 is then turned so that the gripper jaw 203 engages the end of the second shaft 11. When the end of the second shaft 11 is securely gripped by the gripper jaw 203 the motor 189 is again activated to cause the moveable carrage 151 to advance away from the transfer station 5. Since the second shaft 11 is securely gripped by the gripper jaw 203, the second shaft 11 will be caused to advance along with the moveable carriage 151. This results in the second shaft 11 being removed from the center of the rolls of paper 13. As the second shaft 11 is withdrawn from the center of the rolls of the paper 13 the shaft is supported upon the plurality of rollers 173 that are positioned in substantial alignment with the path of travel of the gripper jaw 203. This moveable carriage 151 will advance in a direction away from the transfer station 5 until the second rod 11 has been completely withdrawn from the rolls of paper 13 and the moveable carriage is at the end of the guide rails 153 that are spaced apart from the transfer station 5. The handle means 207 is then manipulated to cause the gripper jaw 203 to release the end of the second shaft 11. The second shaft 11 is then moved to the second row of rollers 173 that are positioned substantially parallel and adjacent to the row of rollers 173 that are positioned in alignment with the path of travel of the gripper jaw 203.

Once the second shaft 11 has been removed from the rolls of paper 13, the moveable cart 21 is moved to be adjacent to the conveyor 25 and the receiving surface 23 on the cart is tipped towards the conveyor 25 by means of the handle 24 which causes the rolls of paper 13 to be transferred to the conveyor 25. The rolls of paper can be transported on the conveyor for further processing. The moveable cart 21 is then moved back into position adjacent to the gripper means 143. The rolls of paper 13 that are supported on first shaft 9 are then deposited on the receiving surface 23 of the moveable cart 21, the hooks 85 are moved from engagement with the first shaft 9 and the first shaft 9 is withdrawn from the rolls of paper 13 by the gripper jaw 203 as previously described. The first shaft 9 is supported on the row of rollers 173 that are in alignment with the path of travel of the gripper jaws 203. The moveable cart 21 is then positioned adjacent to the conveyor 25 and the rolls of paper 13 are transferred from the cart to the conveyor 25 in the manner previously described.

After the rolls of paper 13 that were supported on the first shaft 9 and the second shaft 11 have been transferred to the conveyor 25, the moveable carriage 151 is advanced in a direction away from the receiving station 3 so that the tray 119 attached to the moveable carriage 41 is in substantial alignment with the gripper means 143. The motor 129 is then activated to drive gear reducer 130 and sprocket 131. The sprocket 131 is operatively connected to drive sprocket 133 which is connected to transfer shaft 123 by chain 135. The rotation of transfer shaft 123 causes the gears 127 located on the end of the shaft 123 to also rotate. The gears 127 engage gear rack 121 which is connected to vertical rails 113 of the shaft transfer means 111. Accordingly, the motor 129 can be used to raise and lower the vertical rails 113 of the shaft transfer means 111 to raise and lower the tray 119 that is connected to the end of the vertical rails 113. The motor 129 is activated so that the tray 119 and in particular the grooves 120 on the tray are in substantial alignment with the first shaft 9 and the second shaft 11 that are support on the rolls 173. The handle 217 on the rod 215 is turned so that the flap 213 is positioned substantially perpendicular to the longitudinal axis of the second shaft 11. The flat 213 is disposed in this position so that the flap will engage the end of the second shaft 211 that is spaced apart from the transfer station 5. The gripper jaw 203 will also be positioned so that it engages the end of the first shaft 9 that is spaced apart from the transfer station 5. The moveable carriage 151 is then advanced along the guide rails 153 of the gripper means 143 in a direction towards the transfer station 5. The moveable carriage 151 will be caused to advance by activating motor 189 to cause the moveable carriage 151 to advance along chain 185 as previously described. As the flap 213 and gripper jaw 203 engage the second shaft 11 and first shaft 9 respectively, the shafts will also be advanced as the moveable carriage 151 advances towards the transfer station 5. The moveable carriage 151 will advance until the first shaft 9 and second shaft 11 are positioned in the grooves 120 on the tray 119 and the first and second shaft are no longer positioned in the gripper means 143. The first and second shafts are then free to be transported on the tray 119 back to the receiving station 3. The tray 119 is advanced in a direction towards the moveable carriage 41 on the track means 29 by engaging motor 29 as previously described. The moveable carriage 41 is then advanced along the guide beam 35 of the track means 29 by engaging motor 65 in the manner previously described. The moveable carriage 41 is advanced in a direction towards the receiving station 3. When the tray 119 is in alignment with the position in the receiving station 3 for the second shaft 11, the tray will be advanced in a direction towards the support block 17 until the second shaft 11 is engaged by its support means. The tray 119 is then advanced further below the supported second shaft 11 and the moveable carriage 41 advanced in a direction towards the transfer station 5 for a small distance so that the tray 119 can be advanced in a direction towards the moveable carriage 41 without engaging the second shaft 11. The tray 119 is then advanced towards the moveable carriage 41 until the tray 119 and first shaft 9 are positioned between the second shaft 11 and the track means 29 and the tray 119 is free to again advance in a direction away from the transfer station 5. The carriage 41 is advanced in this direction until the first shaft 9 is in substantial alignment with its position in the receiving station 3. The tray 119 is then caused to advance in a direction towards the support block 17 until the first shaft 9 is engaged by its support means in the receiving station 3. The tray 119 is then advanced further in a direction towards the support block 17 until the tray no longer engages the first shaft 9. The carriage 41 is then advanced in a direction towards the transfer station 5 until the tray 119 is no longer in a position to engage the first shaft 9. The tray 119 is then caused to advance in a direction towards the track means 29 so that the tray means 119 is positioned adjacent to the track means 29. The moveable carriage 41 is then advanced in a direction away from the transfer station 5 until the hooks 85 positioned in substantially the center of the moveable carriage 41 are in substantial alignment with the first shaft 9 and the hooks 85 positioned adjacent the first end 42 of the carrage 41 are in substantial alignment with the second shaft 11. The first shaft 9 and second shaft 11 are then in position to again receive cut paper 7 so that the transfer process can start again.

The above description is given for the sake of explanation and is not to be narrowly construed. Various modifications and substitutions can be made without departing from the scope of the following claims.

What I claim is:

1. A transfer device for moving objects that are supported on shafts from a receiving station to a transfer station, said shafts being disposed in adjacent substantially parallel relationship, said device comprising:

track means extending from said receiving station to said transfer station;

a movable carriage positioned on said track means, said carriage being positioned for movement along said track means;

a drive means mounted on said carriage, said drive means engaging said track means for advancing said carriage along said track from said receiving station to said transfer station;

a plurality of moveable lifting means positioned on said carriage, said lifting means being disposed for engaging said shafts so that said shafts and the objects supported thereon can be transferred from said receiving station to said transfer station, each lifting means being movable independently of the other lifting means to engage said shafts so that said shafts and said objects supported thereon can be independently engaged and lifted from said receiving station by said lifting means; and gripper means located adjacent said transfer station, said gripper means being disposed to grip said shafts that support said objects and to remove said shafts from said objects.

2. The device of claim 1, wherein said lifting means are hooks that extend from said track means.

3. The device of claim 2, wherein an advancement means is positioned on said carriage and said advancement means is operatively connected to said hooks, said advancement means being capable of advancing said hooks to engage said shafts upon which said objects are supported and to advance said hooks to lift said shafts and objects to move said objects from said receiving station.

4. The device of claim 1, wherein said gripper means is moveable in a direction that is parallel to the longitudinal axis of said shafts, said gripper means being capable of withdrawing said shaft from said object by said movement of said gripper means.

5. The device of claim 4, wherein said gripper means has a storage rack for holding said shafts that have been removed from said objects.

6. The device of claim 5, wherein said carriage has means for returning said shafts from said transfer station to said receiving station.

7. A transfer device for moving objects that are supported on shafts from a receiving station to a transfer station, said shafts being disposed in adjacent substantially parallel relationship, said device comprising:

a track means extending from said receiving station to said transfer station;

a moveable carriage means positioned on said track means, said carriage being positioned for movement along said track means, said carriage including means for returning said shafts from said transfer station to said receiving station;

moveable lifting means positioned on said track means, said lifting means being disposed for engaging said shafts so that said shafts and the objects supported thereon can be transferred from said receiving station to said transfer station, each lifting means being moveable independently to engage said shafts so that said shafts and said objects supported thereon can be independently engaged and lifted from said receiving station by said lifting means; and gripper means located adjacent said transfer station, said gripper means being disposed to grip said shafts that support said objects said gripper means being movable in a direction that is parallel to the longitudinal axis of said shafts, said gripper means being capable of withdrawing said shaft from said object by said movement of said gripper means, said gripper means having a storage rack for holding said shafts that have been removed from said objects.

8. The device of claim 1, wherein a tray is connected to said track means, said tray being disposed for receiving said shafts at said transfer station and transportion said shafts back to said receiving station.

9. The device of claim 8, wherein said tray is connected to a carriage that is moveably supported on said track, said carriage being disposed to move said tray from said transfer station to said receiving station.

10. The device of claim 9, wherein said carriage has a drive means for advancing said carriage along said track.

11. The device of claim 10, wherein said carriage has an advancement means that is connected to said tray, said advancement means being disposed for moving said tray for engaging and positioning said shafts.

12. A transfer device for moving objects that are supported on a first shaft and a second shaft from a receiving station to a transfer station; said first and second shafts being disposed in adjacent substantially parallel relationship; said device comprising:

track means extending from said receiving station to said transfer station, said track means having opposed guide beams that are disposed in spaced apart relationship with said receiving and transfer stations, said guide beams extending from said receiving station to said transfer station;

a moveable carriage positioned on said guide beams of said track means, said carriage being moveable between said receiving station and said transfer station;

drive means positioned on said carriage and operatively connected to said guide beams of said track means, said drive means acting to advance said carriage along said track means;

moveable lifting means positioned on said carriage, said moveable lifting means extending from said carriage in a direction towards said first and second shafts, said portion of said lifting means extending towards said first and second shafts including a hook on each side, said hooks being disposed to engage said ends of said first and second shafts;

advancement means positioned on said carriage and operatively connected to said lifting means, said advancement means being capable of moving said lifting means in a direction towards and away from said first and second shafts so that said hooks on said lifting means can engage and lift said shafts and the objects positioned on said shafts;

gripper means positioned adjacent said transfer station, said gripper means being disposed to engage an end of said first and second shafts, said gripper means being moveable in a direction away from said objects positioned on said first and second shafts so that said gripper means can remove said first and second shafts from said objects;

a moveable tray means connected to said moveable carriage positioned on said track means, said tray means extending from said carriage in a direction towards said first and second shafts, said tray means being disposed for receiving said first and second shafts from said gripper means after said first and second shafts have been removed from said objects by said gripper means, said tray means being moveable with said carriage to transfer said first and second shafts from said transfer station to said receiving station; and, advancement means positioned on said carriage and operatively connected to said tray means, said advancement means being capable of moving said tray means in a direction towards and away from said first and second shafts.

13. The transfer device of claim 12, wherein there is a lifting means positioned in substantially the center of said carriage and a lifting means positioned at one end of said carriage, said lifting means in substantially the center of said carriage being disposed to engage said first shaft and said lifting means positioned at one end of said carriage being disposed to engage said said second shaft.

14. The transfer device of claim 13, wherein an advancement means is connected to each of said lifting means, said advancement means being capable of individually moving said lifting means.

15. The transfer device of claim 12, wherein said gripper means is positioned on a moveable transfer carriage, said transfer carriage being positioned adjacent said ftransfer station and being moveable in a direction substantially parallel to the longitudinal axes of said first and second shafts.

16. The transfer device of claim 15, wherein said transfer carriage is positioned on a support column, said transfer carriage being moveable on said support column in a direction that is perpendicular to the longitudinal axes of said first and second shafts.

17. The transfer device of claim 16, wherein drive means is positioned on said transfer carriage for moving said transfer carriage in a direction parallel to the longitudinal axes of said first and second shafts.

18. The transfer device of claim 17, wherein said transfer carriage is moveably supported on guide rails, said guide rails being positioned substantially parallel to the longitudinal axes of said first and second shafts.

19. The transfer device of claim 18, wherein support rollers are positioned between said guide rails, said rollers being positioned in two substantially parallel rows, said rows of support rollers being substantially parallel to said guide rails, said support rollers being disposed for receiving said first and second shafts after said shafts have been removed from said objects by said gripper means.

20. A transfer device for moving rolls of paper that are supported on a first shaft and a second shaft from a receiving station to a transfer station; said first and second shafts being disposed in adjacent substantially parallel relationship; said device comprising:

a track means extending from said receiving station to said transfer station, said track means having opposed guide beams that are disposed in spaced apart relationship with said receiving and transfer stations, said guide beams extending from said receiving station to said transfer station, said track means being positioned in spaced apart relationship and above said receiving and transfer stations;

a moveable carriage positioned on said guide beams of said track means, said carriage being moveable between said receiving station and said transfer station;

drive means positioned on said carriage and operatively connected to said guide beams of said track means, said drive means acting to advance said carriage along said track means;

moveable lifting means positioned in substantially the center of said carriage and moveable lifting means positioned at one end of said carriage, said moveable lifting means extending from each side of said carriage in a direction towards said first and second shafts, said portion of said lifting means extending towards said first and second shafts including a hook, said hooks being disposed to engage said ends of said first and second shafts, said hooks connected to said lifting means located substantially in said center of said carriage being disposed to engage said first shaft and said lifting means located at said end of said carriage being disposed to engage said second shaft;

advancement means positioned on said carriage and operatively connected to each of said lifting means, said advancement means being capable of individually moving said lifting means in a direction towards and away from said first and second shafts so that said hooks on said lifting means can engage and lift said shafts and the rolls of paper positioned on said shafts;

a moveable transfer carriage positioned adjacent said transfer station, said carriage being moveable in a direction that is substantially parallel to the longitudinal axes of said first and second shaft and in a direction that is substantially perpendicular to the longitudinal axes of said first and second shafts;

gripper means positioned on said moveable transfer carriage, said gripper means being disposed to engage an end of said first and second shafts, said transfer carriage and gripper means being moveable in a direction away from said object positioned on said first and second shafts so that said gripper means can remove said first and second shafts from said rolls of paper;

drive means positioned on said transfer carriage for moving said transfer carriage and said gripper means in a direction that is substantially parallel to the longitudinal axis of said first and second shafts;

a moveable tray means connected to said moveable carriage that is positioned on said track means, said tray means extending from said carriage in a direction toward said first and second shafts, said tray means being disposed for receiving said first and second shafts from said gripper means after said first and second shafts have been removed from said rolls of paper by said gripper means, said tray means being moveable with said carriage to transfer said first and second shafts from said transfer station to said receiving station;

advancement means positioned on said carriage and operatively connected to said tray means, said advancement means being capable of moving said tray means in a direction towards and away from said first and second shafts.

21. The transfer device of claim 20, wherein said transfer carriage is supported on moveable guide rails, said guide rails being moveable in a direction perpendicular to the longitudinal axis of said first and second shafts so that said gripper means can be positioned to engage said first and second shafts.

22. The transfer device of claim 21, wherein support rollers are positioned between said guide rails for supporting said first and second shafts after said shafts have been removed from said rolls of paper in said transfer station.

23. The transfer device of claim 22, wherein engagement means is positioned on said transfer carriage for engaging said first and second shafts when said shafts are positioned on said support rollers so that said shafts can be advanced from said support rollers onto said tray means.

24. The transfer device of claim 20, wherein said gripper means includes a gripper jaw, said gripper jaw being disposed for releasable engaging one end of said first or second shafts so that said shafts can be removed from said rolls of paper, said gripper jaw releasing said first or second shaft after said shaft has been removed from said rolls of paper.

* * * * *